US006094875A

United States Patent [19]

Laine

[11] Patent Number: 6,094,875

[45] Date of Patent: Aug. 1, 2000

[54] REMOVABLE WALL ASSEMBLY

[75] Inventor: Michel Laine, Lévis, Canada

[73] Assignee: Burkiss Inc., Levis, Canada

[21] Appl. No.: 09/043,357

[22] PCT Filed: Jul. 30, 1997

[86] PCT No.: PCT/CA95/00542

§ 371 Date: May 16, 1998

§ 102(e) Date: May 16, 1998

[87] PCT Pub. No.: WO98/04787

PCT Pub. Date: Feb. 5, 1998

Related U.S. Application Data

[60] Provisional application No. 60/022,400, Jul. 30, 1996.

[51] Int. Cl.[7] ..... E04B 2/74

[52] U.S. Cl. ..... 52/220.7; 52/238.1; 52/242; 52/126.3

[58] Field of Search ..... 52/220.7, 238.1, 52/241, 242, 126.3

[56] References Cited

U.S. PATENT DOCUMENTS

| | | | |
|---|---|---|---|
| 2,097,484 | 11/1937 | Winslow | 52/220.7 X |
| 3,101,817 | 8/1963 | Radek | 52/241 |
| 3,195,698 | 7/1965 | Codrea | 52/220.7 X |
| 4,103,463 | 8/1978 | Dixon | 52/241 X |
| 4,470,232 | 9/1984 | Condevaux et al. | 52/220.7 |
| 4,631,881 | 12/1986 | Charman | 52/220.7 |
| 4,685,255 | 8/1987 | Kelley | 52/36 |
| 4,833,849 | 5/1989 | Williams et al. | 52/281 |
| 4,841,699 | 6/1989 | Wilson et al. | 52/241 X |
| 4,891,920 | 1/1990 | Pingston | 52/220.7 X |
| 4,893,446 | 1/1990 | Gudmundsson et al. | 52/241 X |
| 5,020,290 | 6/1991 | Hajjar | 52/242 |
| 5,062,246 | 11/1991 | Sykes | 52/126.4 |
| 5,065,556 | 11/1991 | DeLong et al. | 52/220.7 |
| 5,155,955 | 10/1992 | Ball et al. | 52/126.4 |
| 5,307,600 | 5/1994 | Simon, Jr. et al. | 52/241 |
| 5,822,935 | 10/1998 | Mitchell et al. | 52/220.7 X |

FOREIGN PATENT DOCUMENTS

| | | |
|---|---|---|
| 900083 | 11/1984 | Belgium . |
| 0006707 | 1/1980 | European Pat. Off. . |
| 0200514 | 11/1986 | European Pat. Off. . |
| 2326546 | 4/1977 | France . |
| 2630145 | 4/1988 | France . |
| 92/12300 | 7/1992 | WIPO . |

*Primary Examiner*—Robert Canfield
*Attorney, Agent, or Firm*—Darby & Darby

[57] ABSTRACT

A modular wall panel to extend between a floor and ceiling has top and bottom horizontal main runners between two vertical beams, each beam having a foot which rests on the floor, the foot being adjustable to adjust the panel height. A first pair of opposing spaced panels extend between the two vertical beams and have lower edges that rest on the bottom main runner and a lower mid-height runner is mounted on the upper edges of the first panel pair to support a horizontal I-beam extending between the vertical beams. An upper mid-height runner is supported on the upper edge of the I-beam and there are a second pair of spaced opposing panels having their lower edges mounted on the upper mid-height runner supported on the I-beam and their upper edges are held by the main runner. A cover member is provided to cover each face of the I-beam. There can be one or more additional pairs of mid-level runners between the I-beam and the upper main runner to support one or more further pairs of spaced opposing panels and insulation can be placed in the space between each of the panels of a pair.

11 Claims, 16 Drawing Sheets

REMOVABLE WALL ASSEMBLY

RELATED APPLICATION

This application is based on Provisional Application 60/022,400 filed on Jul. 30, 1996 and claims the benefit of domestic priority thereof.

FIELD OF THE INVENTION

The invention relates to a removable wall assembly. More particularly, the invention relates to such a removable wall assembly where the assembled product is equivalent to a standard wall, but which has the advantage of being easily removable and which integrates horizontal and vertical dispatching of utility services such as electricity, telephone services and computer communication services.

DESCRIPTION OF THE PRIOR ART

When separating a large room in order to delineate offices or office space, two traditional approaches exist: permanently building walls or using divider panels.

Permanent walls require a rigid frame structure upon which panels are fastened and through which various utility services are integrated. This has two major disadvantages, the first being that should a reorganization of the space be required, it is necessary to tear down the existing structure at great cost, and rebuild according to the new specifications; and the second being that once the utility services are installed, it is almost impossible to relocate them without tearing down a portion of a wall, which requires expense and inconvenience (i.e. rebuilding, repainting, etc.) The advantage of building a permanent wall structure is that it provides great soundproofing and that is has an improved aesthetic quality.

Divider panels, or acoustic panels, are well known in the field, and come in various designs, shapes, etc. Some of the panels may extend from floor to ceiling, but most are of a standard height of approximately seven feet, or a little over two meters. Most of these assemblies are not aesthetically pleasing, do not provide for adequate privacy, and some, if not most, are relatively complicated to assemble and require specific components. Their advantage is that, more recently, most are "pre-wired" for utility services, rendering such services easily accessible. Another advantage is that they are modular. and usually can be reorganized with a minimum of inconvenience and cost.

It is thus an object of the present invention to provide a removable wall assembly which combines the soundproofing qualities of a permanent wall and the modularity and ease of installation of divider panels.

SUMMARY OF THE INVENTION

In accordance with the invention, this object is achieved with a modular wall assembly for mounting between a ceiling and a floor. The modular wall assembly includes an elongated top runner having a longitudinal axis, two opposite sides, a top surface, a bottom surface and a generally inverted U-shaped cross-section. The top runner has a groove parallel to the longitudinal axis on each opposite side opening towards the floor and is compatible with the ceiling for attachment thereto.

The modular wall assembly also includes at least two vertical beams each having an adjustable foot at the bottom thereof, each of the vertical beams having a plurality of longitudinal partitions for vertical dispatching of utility services. Each of the vertical beams has a length corresponding generally to the height of the ceiling and each is provided with support means extending parallel to the longitudinal axis of the top runner at the bottom of the vertical beams.

Each of the vertical beams further includes means for extending each of the adjustable foot to account for variations in the height of the ceiling.

A bottom runner having two opposite sides, two opposite ends, a top surface, a bottom surface, a generally U-shaped cross-section and a groove parallel to the longitudinal axis of the top runner on each opposite side defining an opening on the top surface thereof is inserted between two adjacent vertical beams. Each end of the bottom runner rests on a corresponding one of the support means.

A first pair of panels having a horizontal longitudinal axis, has a bottom longitudinal edge resting in one of the grooves of the bottom runner and a top longitudinal edge.

Lower and upper mid-height runners are also provided, the mid-height runners being mirror images of each other along a longitudinal axis, and being in the same shape and form as the bottom runner. The mid-height runners are vertically separated by a generally I-shaped beam defining an opening therebetween on each opposite side of the wall assembly and are inserted between two adjacent vertical beams. The lower mid-height runner has a groove on each opposite side opening towards the floor and adapted to receive the top edge of the corresponding panel of the first pair of panels.

A second pair of panels having a horizontal longitudinal axis, has a bottom longitudinal edge resting in a respective one of the grooves of the upper mid-height runner, and a top longitudinal edge inserted in a respective one of the grooves of the top runner.

At least one modular panel removably covers the opening defined by the I-shaped beams on each opposite side, for horizontally dispatching the utility services.

It is to be stressed that the wall assembly of the invention combines the modularity of acoustical panels with the finished look and strength of a traditional permanent wall, including adequate soundproofing.

Further, the present invention requires minimal mechanical fasteners, which makes assembling and disassembling of the wall assembly easy and rapid, as will be hereinafter detailed.

As well, the present invention allows for vertical and horizontal dispatching of utility services. Preferably, the horizontal dispatching is at a height of approximately 30" from the floor, and can also be dispatched at a height closer to the ceiling i.e. approximately 7' from the floor, for feeding spotlights, for example. Additionally, the utility services are pre-wired into the removable wall assembly, as will hereinafter explained.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
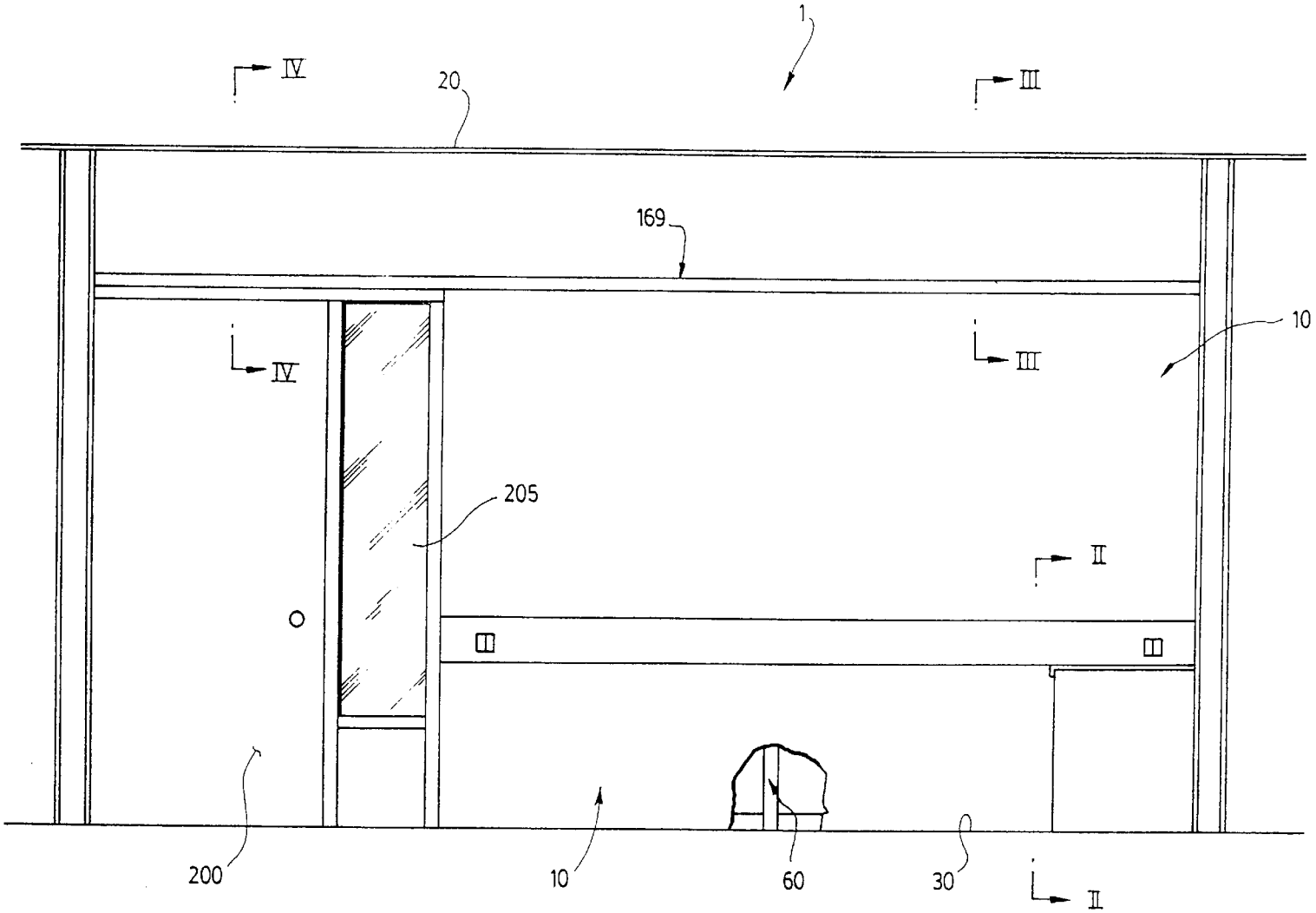
FIG. 1 is a front elevational view of a wall assembly according to the present invention.

Referring now to FIG. 1, there is shown a plurality of removable wall assemblies for mounting between a ceiling 20 and a floor 30 according to the present invention, incorporating a door 200, a window 205 and vertical and horizontal dispatching of utility services.

Figure 3:
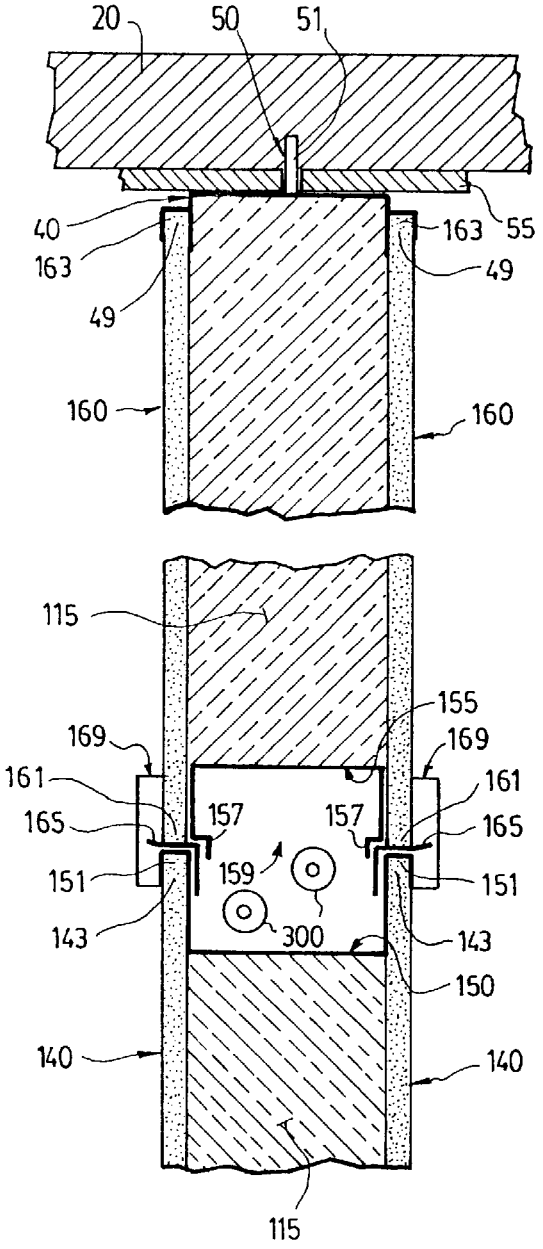
FIG. 3 is a cross-sectional view taken along line III—III of FIG. 1.
Figure 4:
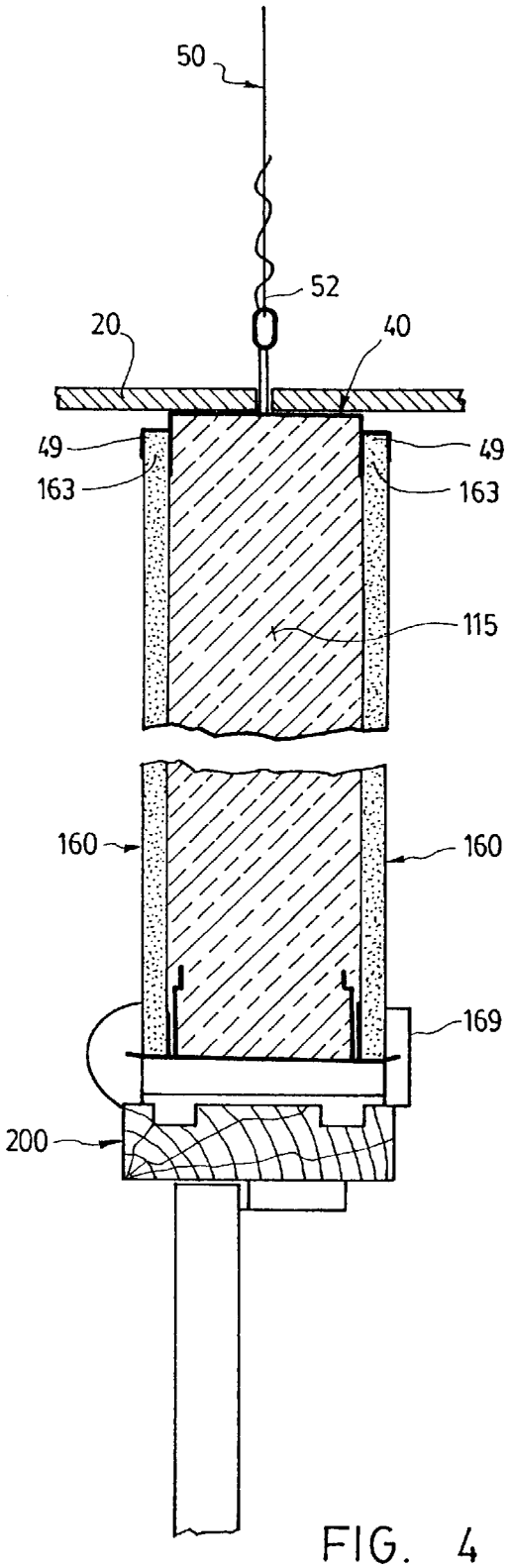
FIG. 4 s a cross-sectional view taken along line IV—IV of FIG. 1.

Such a wall assembly is erected by fastening to the ceiling 20 a top runner 40 as shown on FIGS. 3 and 4. It should be understood that when reference herein is made to "ceiling", it includes not only the "false" ceiling present in many offices, usually made of acoustical panels supported by a frame, but also the "true" ceiling, usually made of concrete.

Figure 13:
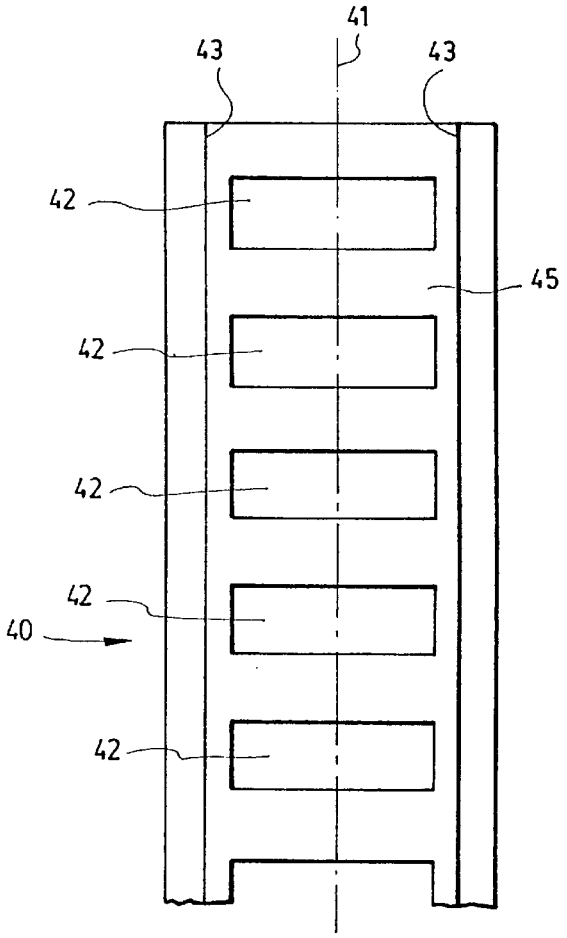
FIG. 13 is a top plan view of the top runner of FIG. 12.
Figure 11:
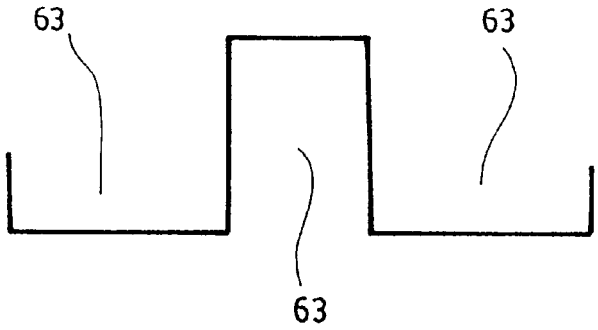
FIG. 11 is a sectional view of half of a vertical post.
Figure 12:
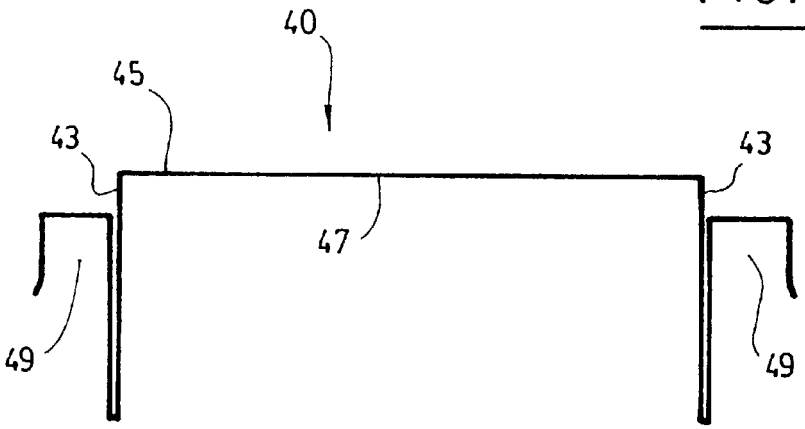
FIG. 12 is a cross-sectional view of a top runner according to the invention.
Figure 14:
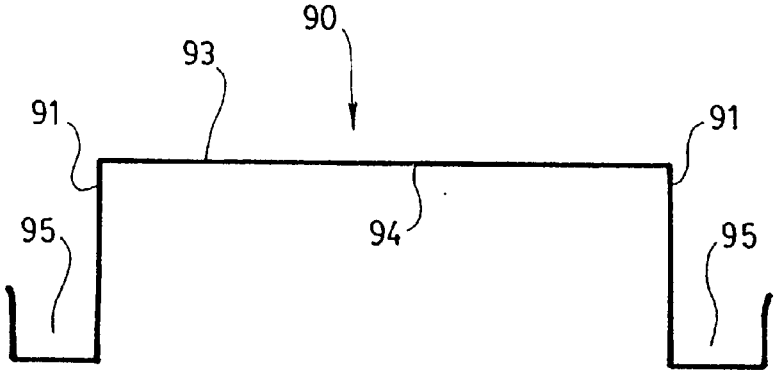
FIG. 14 is a cross-sectional view of a bottom runner according to the present invention.

The top runner 40 is better shown on FIGS. 12 and 13 and has a longitudinal axis 41, two opposite sides 43, a top surface 45, a bottom surface 47 and a generally inverted U-shape. The top runner 40 has a groove 49 parallel to the longitudinal axis 41 on each opposite side 43 that opens towards the floor 30. It should be noted that the top runner 40 may also include a plurality of openings 42, as shown on FIG. 13.

The top runner 40 is fastened to the ceiling either by means 50 of mechanical fasteners such as screws 51 (FIG. 3) for attachment directly to the ceiling or a wire 52 (FIG. 4). It should be noted that any other means 50 for fastening the top runner 40 is acceptable, as long as there is sufficient lateral stability. It will be understood from the following description that the top runner 49 is the only component which receives mechanical fasteners 50 for stabilizing the assembly 10, and that the means 50 for fastening the top runner 40 only serve to retain the top runner 40 in position, not to laterally or longitudinally stabilize the entire structure. Furthermore, the fastening of the top runner 40 permits easy alignment of the complete structure since ceilings 20 are usually straighter than floors 30. It should be apparent to a person skilled in the art that a thin layer of insulator 55 may be installed between the ceiling 20 and the top surface 45 of the top runner 40 as shown on FIG. 3.

Figure 7:
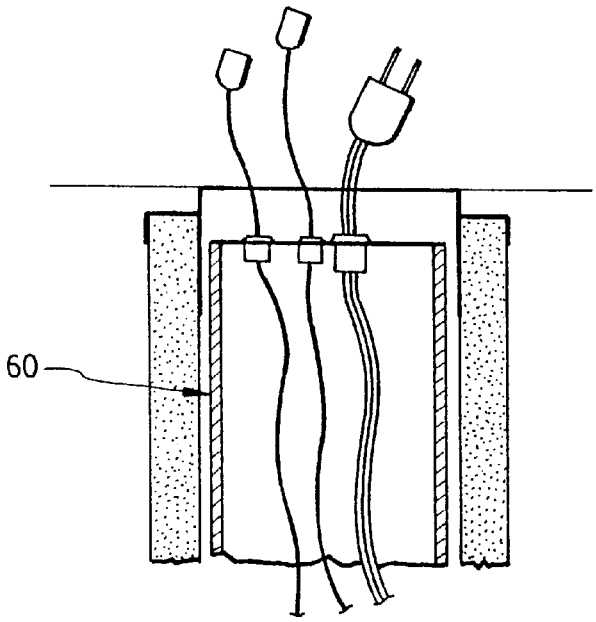
FIG. 7 is across-sectional view taken along line VII—VII of FIG. 6*a;*

Once the top runner 40 is installed, a plurality of vertical beams 60 are placed at equal intervals, preferably 4' from each other. The vertical beams 60, shown on FIGS. 6*a*, 7, 9, 10, 11 and 19 have a ceiling end 61, a floor end 62 and a length generally corresponding to the height of a ceiling 20 (usually approximately 9'). The top runner 40 includes means for retaining in position the ceiling end 61 of the vertical beams 60. To that effect, the ceiling end 61 is preferably adapted to be inserted into the inverted U-shape of the top runner 40 on the bottom surface 47, as shown on FIG. 7. This provides for lateral stability of the vertical beams 60.

Figure 9:
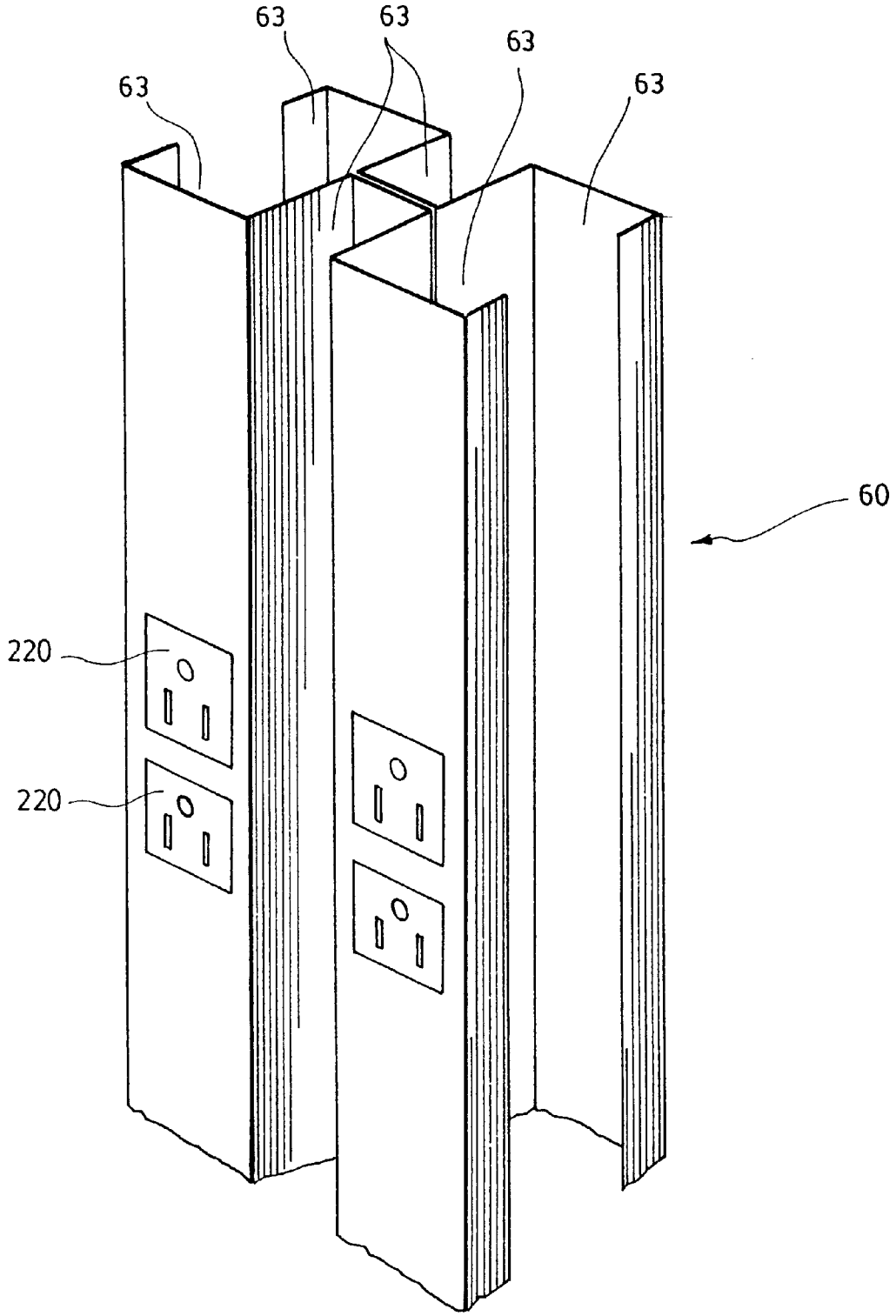
FIG. 9 is a perspective view of a portion of a vertical post.

The vertical beams 60 have a plurality of longitudinal partitions 63 for vertical dispatching of utility services. Preferably, the vertical beams 60 have the profile shown on FIG. 9 and can be made of two identical pieces of metal having the individual profile of FIG. 11 or from a single piece of metal. As such, the profile automatically delineates a plurality of longitudinal partitions 63. In the case of FIG. 9, it can be seen that the partitions 63 on the outside of the beam 60 are used to carry electrical services, whereas the center partitions 63 are used to carry the other services, such as telecommunications, cable, security, fiber optics, etc.

Figure 10:
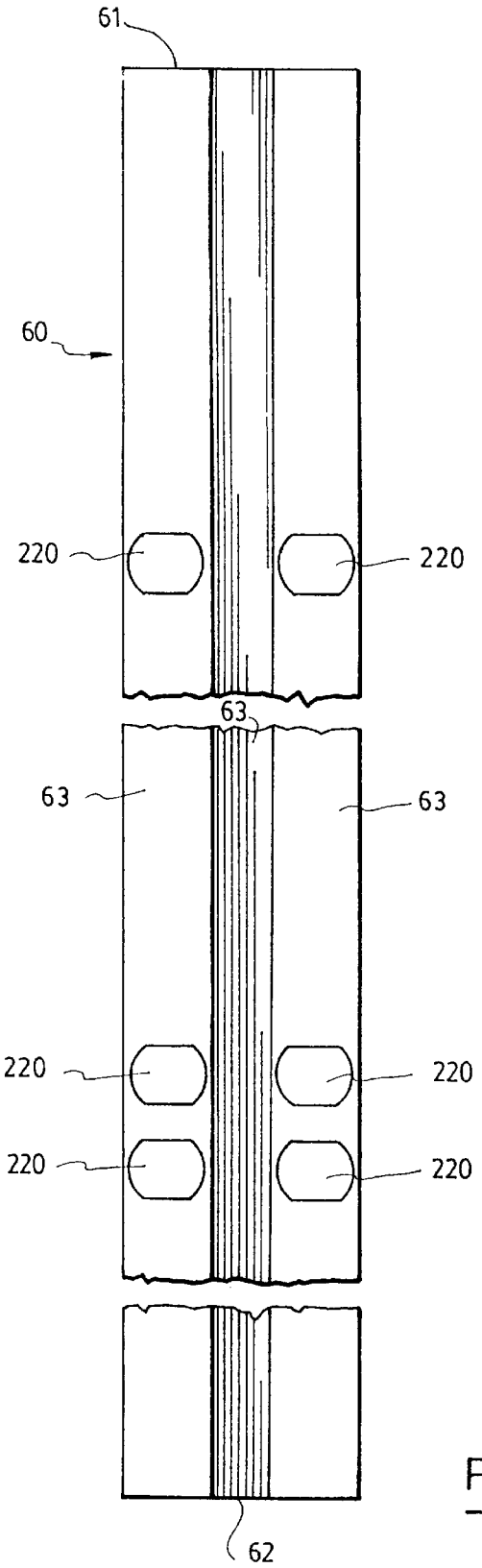
FIG. 10 is a lateral view of a vertical post.

Preferably, the vertical beams 60 are provided with standard electrical outlets 200 at a distance of approximately 30" from the floor end 62 of the vertical beams 60, as better shown on FIGS. 9 and 10, where the partitions 63 closer to each opposite side of the wall assembly according to the invention carry the electrical wires necessary to feed the electrical outlets 220. The center partition 63 thus carries the non-electrical utilities such as television cable, telephone, communications, etc. It is thus to be noted that on either the right or the left of the vertical beam 60 when looking at FIG. 10, all of the utility services are easily accessible. If the vertical beams 60 are provided with standard electrical outlets 220, they are preferably encased in a junction box 201 (see FIG. 19) for increased safety. However, it is not necessary for the purposes of the invention that any of the electrical utilities be so protected, as long as the vertical beams 60 have partitions that vertically dispatch the utilities.

Figure 19:
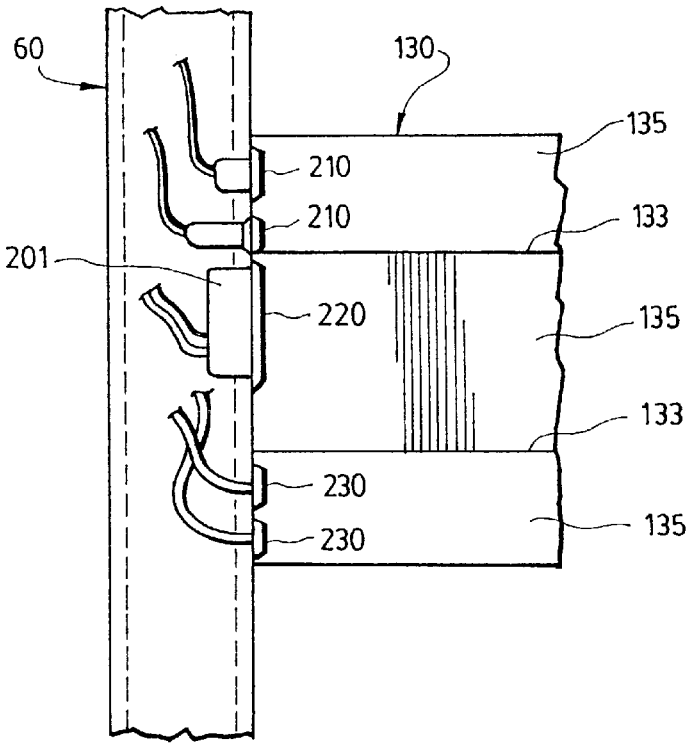
FIG. 19 is a schematic representation of the vertical dispatching of utility services in a vertical post.
Figure 20:
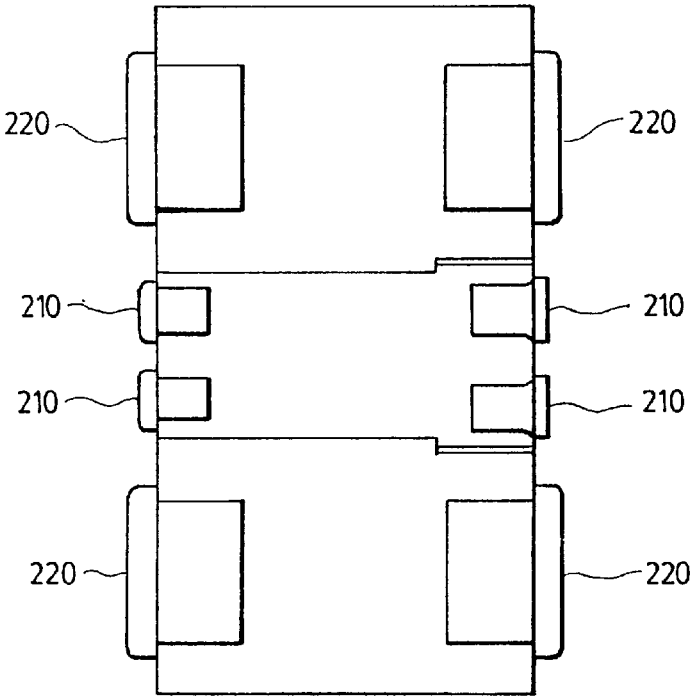
FIG. 20 is a cross-sectional view of a vertical post showing the separation between each of the utility services.

However, in the matter of a preferred embodiment, the utilities may be accessible as shown on FIG. 19, which shows a partial section of a vertical beam 60. In this case, the non-electrical utilities are placed above and below the electricity, and each is terminated by the appropriate socket 220, 230 fastened to the vertical beam 60 in order to increase the modularity of the assembly. FIG. 20 shows a top plan view of a vertical beam 60 including sockets 220, 230 for each of the utilities.

As also shown on FIG. 10, the vertical beam 60 may also be provided with standard electrical outlets 220 at a distance of approximately 2' from the ceiling end 61 of the vertical beam 60.

The vertical beams 60 are also provided with support means 70 extending parallel to the longitudinal axis 41 of the top runner 40 at the floor end 62. The vertical beams 60 are each further provided with an adjustable foot 80 to account for small variations in the height of the ceiling 20, where the adjustable foot 80 is longitudinally extendable.

Figure 16A:
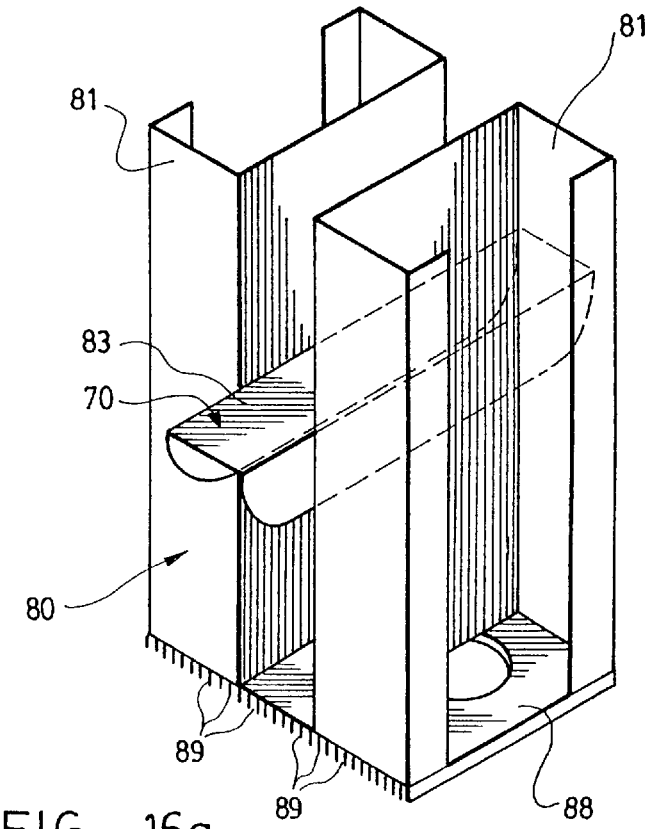
FIG. 16*a* is a perspective view of an adjustable foot.
Figure 16B:
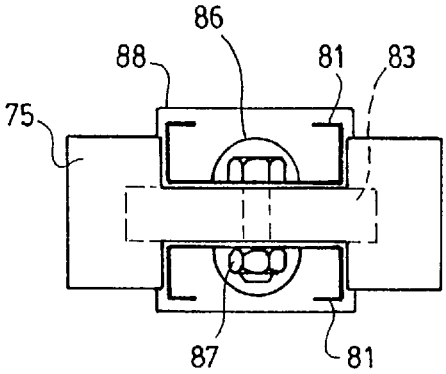
FIG. 16*b* is a top plan view of the adjustable foot of FIG. 16*a;*
Figure 17:
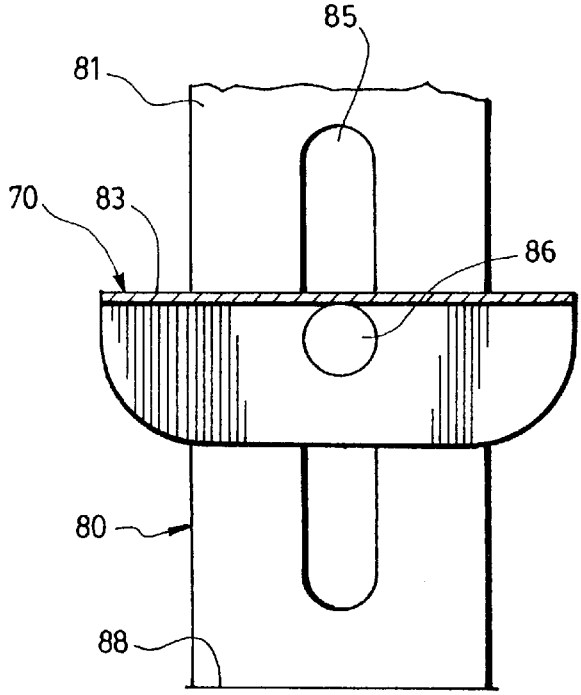
FIG. 17 is a cross-sectional elevation view of the adjustable foot of FIGS. 16*a* and 16*b;*

Preferably, the support means 70 are incorporated to the adjustable foot 80, as better shown on FIGS. 16*a*, 16*b* and 17. The adjustable foot 80 comprises two generally rectangular, hollow pieces 81 and a support member 83 inserted therebetween, the support member 83 having a generally rectangular top surface, along the long axis of the rectangular top surface. Each of the pieces 81 is provided with a longitudinal groove 85, preferably having a length of approximately 3". A nut 86 and screw 87 assembly secures each of the pieces 81 and the support member 83 together, as shown on FIG. 16*b*. A bottom plate 88 is further fastened to the bottom of the pieces 81, as better shown on FIGS. 16*a* and 16*b*, preferably by soldering. The assembled support foot 80 is adapted to be slidably inserted into the vertical beam 60 at the floor end 62 thereof Thus, the ceiling end 61 of the vertical beam 60 is inserted into the top runner 40 and the adjustable foot 80 can be extended at the required distance so that the bottom plate 88 rests on the floor 30 (see FIG. 5). The support member 83 is then adjusted so that it is flush with the floor end 62 of the vertical beams 60 and therefore each of the support members 83 is located at the same distance from the ceiling 20 towards the floor 30 and the adjustable foot 80 allows for variations in the height of the ceiling 20 to the floor 30, and all of the support members 83 are in horizontal alignment with each other.

Figure 5:
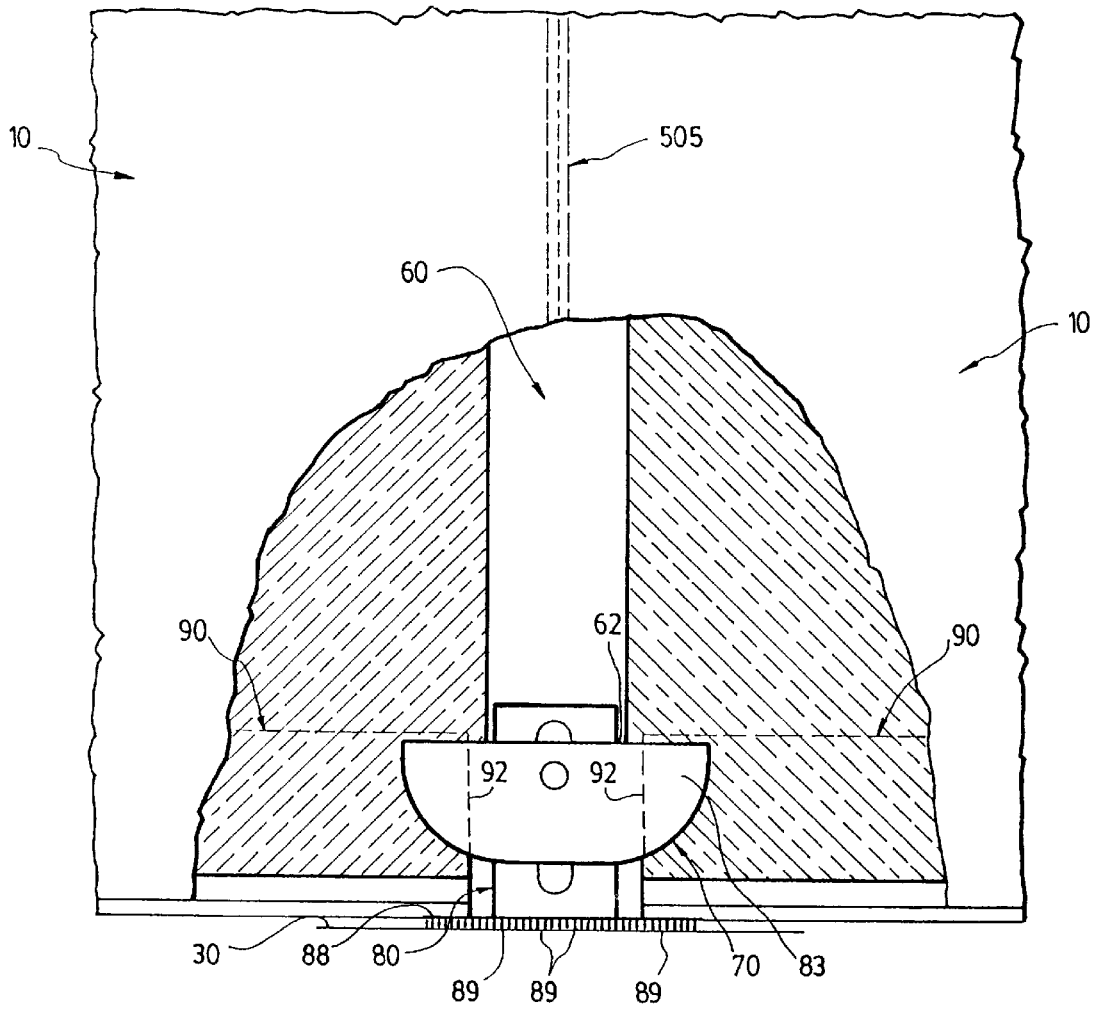
FIG. 5 is a detailed view of the cut-out portion shown at the bottom of FIG. 1.

Preferably, the bottom plate 88 is further provided with a comb structure 89 as shown on FIGS. 5 and 16*a*, which comb structure 89 is adapted to be placed on a carpet in order to avoid flattening the carpet and to laterally secure the assembly.

Figure 18A:
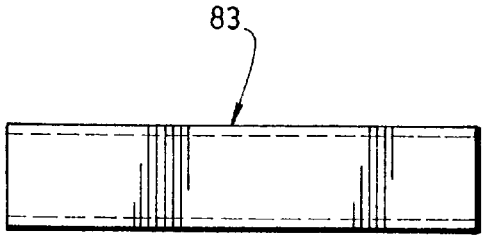
FIGS. 18*a*, 18*b*, 18*c* are detailed views of the support means of the vertical beam.
Figure 18B:
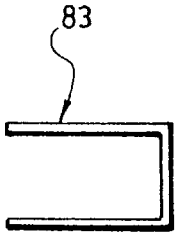
Figure 18C:
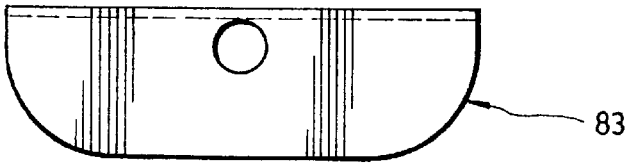
Figure 27:
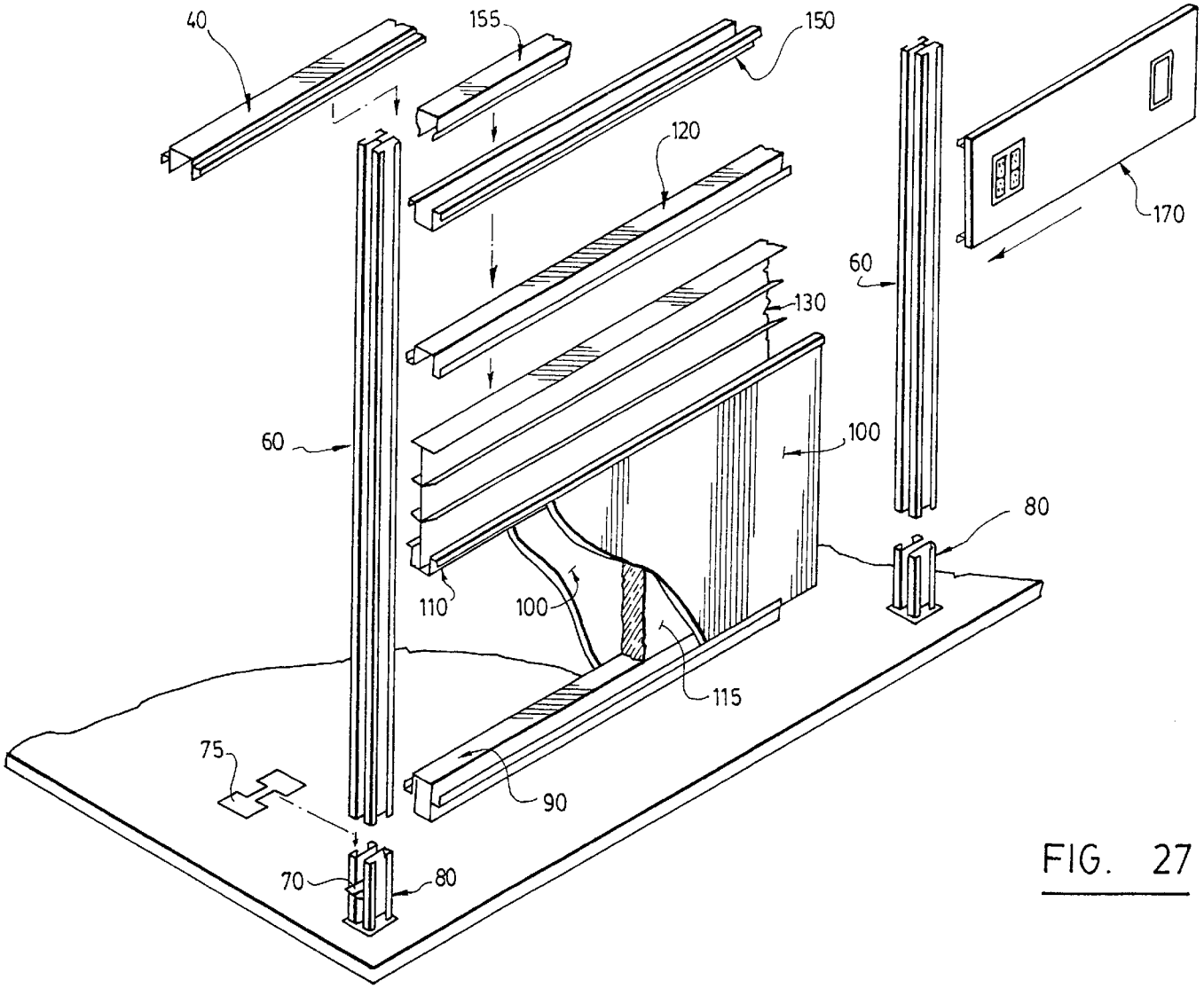
FIG. 27 is an exploded view of a partly assembled wall assembly according to the invention.

The support member 83 has a generally inverted U-shape and has a rectangular top surface, as previously mentioned and shown on FIG. 18*a*. The support member 83 can also be provided with an additional support plate 75 as shown on FIGS. 16*b* and 27, which forms part of the support means 70 and increases the surface area that supports the assembly, as will be better understood hereinafter.

A bottom runner 90 having two opposite sides 91, two opposite ends 92, a top surface 93, a bottom surface 94, a generally U-shaped cross-section, a groove 95 parallel to the longitudinal axis of the top runner 40 on each opposite side 91 defining an opening towards the ceiling 20 and having a length corresponding to the distance between two adjacent vertical beams 60, preferably 4', is inserted between two adjacent vertical beams 60. Each opposite end 92 of the bottom runner 90 rests on a corresponding one of the support members 83 of the vertical beams 60 as better shown on FIG. 5. In order to increase the surface area which supports the structure, the support members 83 of the vertical beams 60 may further be provided with a support plate 75, having a central portion similar in shape and size to the top surface of the support member 83, and a longitudinal extension on each opposite end, which has a width that is larger than the width of the support member 83, as better shown on FIG. 16*b*.

Figure 2:
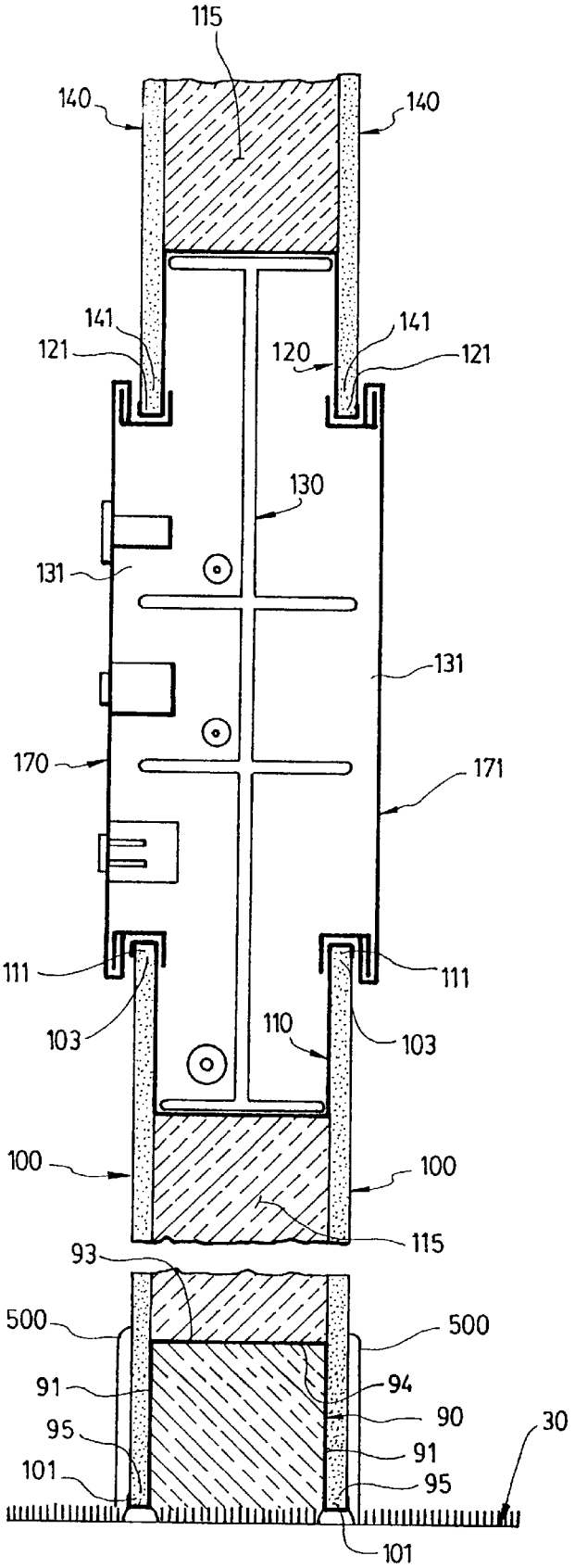
FIG. 2 is a cross-sectional view taken along line II—II of FIG. 1.

A first pair of panels 100 having a horizontal longitudinal axis, a bottom 101 and top 103 longitudinal edges are secured on each side of the wall assembly by having their respective bottom longitudinal edge 101 resting in one of the grooves 95 of the bottom runner 90, as better shown on FIG. 2. Between each panel 100 of the first pair of panels, insulating means 115 are inserted to provide for adequate acoustic insulation. Preferably, the panels 100 have a width of approximately 30", so that the top longitudinal edge 103 thereof is approximately at a distance of 30" from the floor 30.

The removable wall assembly 10 according to the invention also includes lower 110 and upper 120 mid-height runners being mirror images of each other along a longitudinal axis and being in the same shape and form as the bottom runner 90. The lower 110 and upper 120 mid-height runners are inserted between two adjacent vertical beams 60. The mid-height runners 110, 120 are vertically separated by a generally I-shaped beam 130 defining an opening 131 therebetween on each opposite side of the wall assembly 10. The lower mid-height runner 10 has a groove 111 on each opposite side opening towards the floor 30 adapted to receive the top longitudinal edge 103 of the corresponding panel of the first pair of panels 100. The upper mid-height runner 120 also has a groove 121 on each opposite side opening towards the ceiling 20.

Figure 15:
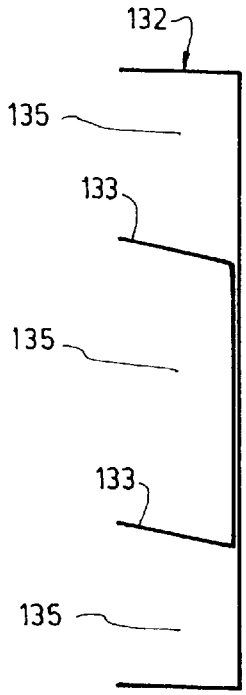
FIG. 15 is a cross-sectional view of half of an I-beam according to the invention.

The generally I-shaped beam 130, shown on FIGS. 2 and 15, is preferably made of two generally U-shaped pieces 132 fastened back to back. FIG. 15 shows half of an I-shaped beam 130. In order to provide for adequate soundproofing, a thin sheet of insulating resin (not shown) is preferably fastened to the back of each of the U-shaped pieces 132.

Further, each of the U-shaped pieces 132 is provided with two longitudinal flanges 133 defining three channels 135, which can be oriented slightly upwardly. These channels 135 serve to separate the electrical utilities from the non-electrical utilities. Thus, as shown on FIG. 19, the middle channel 135 is used for electrical utilities, whereas the top and bottom channels 135 are used for non-electrical utilities.

A second pair of panels 140, having a longitudinal axis, have a bottom longitudinal edge 141 resting in a respective one of the grooves 121 of the upper mid-height runner 120. The second pair of panels 140 also has a top longitudinal edge 143 inserted in a respective one of the grooves 49 of the top runner 40. This of course is in the case where the second pair of panels 140 has a sufficient width to cover the span between the upper mid-height runner 120 and the top runner 40. As before, between each panel of the second pair of panels 140, insulating means 115 are inserted to provide for adequate acoustic insulation.

Alternatively, in the case where the second pair of panels 140 does not have such a width, the top longitudinal edge 143 of the second pair of panels 140 can be inserted into a groove 151 of a horizontal runner 150 having the same shape and size as the bottom runner 90 or the mid-height runners 110, 120, as shown on FIG. 3. A rectangular tube 155 is inserted over the horizontal runner 150 and has a pair of parallel, downwardly projecting flanges 157 to retain the rectangular tube 155 in position over the horizontal runner 150 and an opening 159 at the bottom thereof A third pair of panels 160, having a longitudinal axis, have a bottom longitudinal edge 161 resting on top of the horizontal runner 150 on each opposite side and a top longitudinal edge 163 inserted in a respective one of the grooves 49 of the top runner 40. The third pair of panels 160 are held in position by means of an L-shaped bracket 165 placed at regular intervals. When putting the finishing touches to the wall, a finish moulding 169 shown on FIG. 3 will hide the joint between the two rows of panels 140, 160. As before, between each panel of the third pair of panels 160, insulating means 115 are inserted to provide for adequate acoustic insulation. It can thus be seen that the modular wall assembly of the present invention can be extended to the "false" ceiling, or to the "true" ceiling with a minimum of inconvenience.

As can be seen from FIG. 3, the juxtaposition of the horizontal runner 150 and the rectangular tube 155 create a longitudinal opening at approximately a distance of 7' from the floor, through which, for example, electrical utilities 300 may be vertically dispatched in order to feed spotlights, as better shown on FIG. 1.

Figure 24:
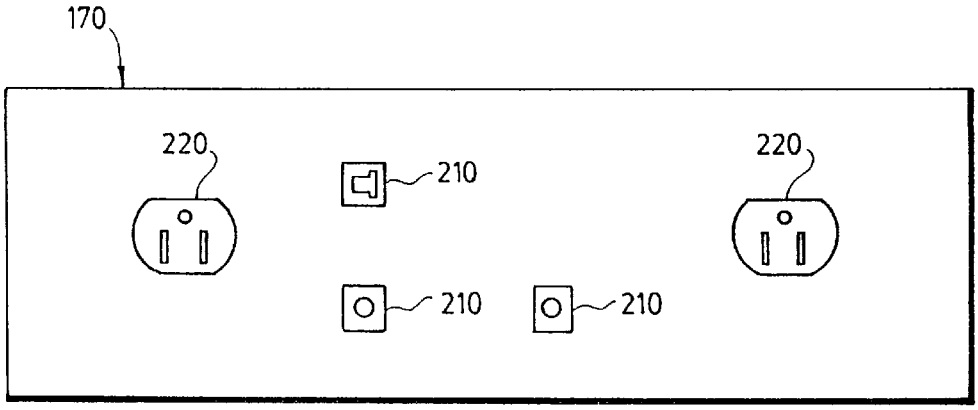
FIG. 24 is a front view of a modular panel, including pre-wired utility services.
Figure 25:
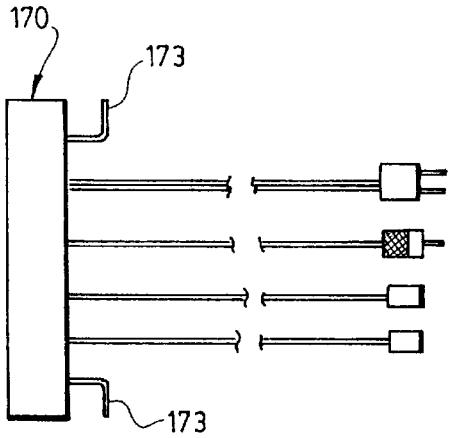
FIG. 25 .is a side view of the modular panel of FIG. 24.
Figure 26:
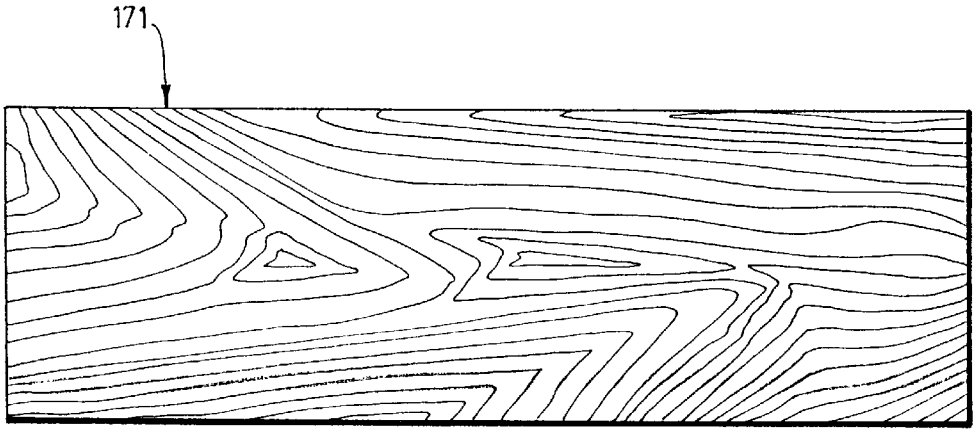
FIG. 26 is a front view of a cover panel without pre-wired utility services.

A pair of modular panels 170, illustrated on FIGS. 24, 25 and 26 removably cover the opening 131 defined by the I-shaped beam 130 on each opposite side of the wall assembly 10 for horizontally dispatching the utility services. Such a panel is shown on FIG. 24, where the panel is preferably pre-fitted with standard electrical 220, cable 230, telephone 210 or other sockets. Each of these sockets is operatively connected to the respective feeder cable for the appropriate utility, preferably through the use of sockets 220, 210, 230 fastened to the vertical beams, as shown on FIG. 19. It is important for the purposes of the invention that at least one modular panel 170 be pre-wired with at least one socket.

However, it can also be desired to simply have a plain moulding covering the opening 131 defined by the I-shaped beam 130. In such a case, a standard modular panel 171 with no utility sockets can be used.

Preferably, the panels 170, 171 each have a length of approximately 4', so that there is a plurality of such panels 170, 171 on each side of the removable wall assembly 10. Thus, only the required number of "wired" panels 170 need be used for a particular configuration. Furthermore, if a rearrangement of the utilities is required, all that is needed is to remove the wired panel 170 and disconnect the utilities and replace it with a plain panel 171. Since all of the vertical beams 60 are fed with the utilities, it can be easily seen that rearrangement is easy.

Furthermore, a modular panel may easily integrate other utilities, such as a thermostat or a light switch, or any other control system with the appropriate feeding.

The modular panels 170, 171 are fastened to the removable wall assembly with fastening means. Preferably, these means comprise a pair of brackets 173 on the top and the bottom of the panel. These brackets can be sized to allow insertion and fixation of the panel into the opening after the upper and lower mid-height runners are assembled. Such is better shown on FIG. 2.

The removable modular wall assembly of the present invention can thus be used to build any type of wall which is easily erected, includes utility services at regular intervals, and provides for adequate soundproofing. Thus, FIG. 1 shows a wall including a door 200 and a window 205, and the detail of where the door frame is fastened is shown on FIG. 4.

Figure 6A:
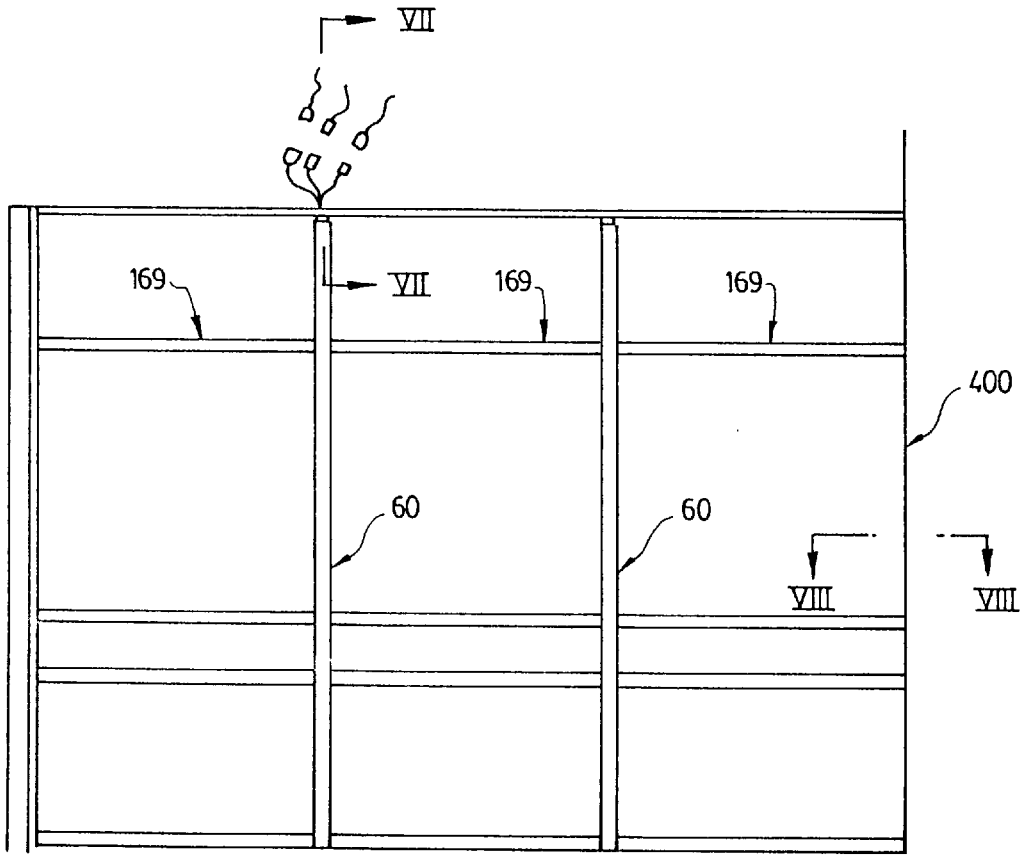
FIG. 6*a* is another front elevational view of a wall assembly according to the present invention Sowing attachment to an existing permanent wall.
Figure 6B:
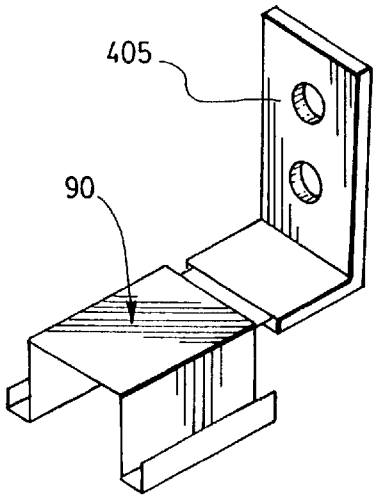
FIG. 6*b* is a perspective view of the means used to support the bottom runner when attached to an existing permanent wall.
Figure 8:
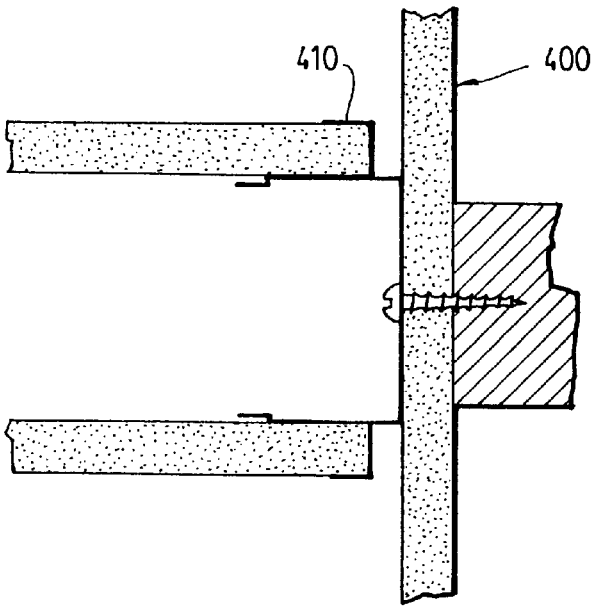
FIG. 8 is a cross-sectional view taken along line VIII—VIII of FIG. 6*a;*

FIG. 6 shows a wall assembly 10 including two vertical beams 60, but where the left end of the wall assembly 10 is secured to an existing wall 400. In such a case, the panels may be supported by a vertical runner 410 of the same shape and size as the top runner 40, as shown on FIG. 8, which is fastened to the existing wall 400. Also in such cases, the bottom runner 90 adjacent the wall 400 can be supported by and L-shaped bracket 405 which itself is fastened to the wall 400.

Also shown on FIG. 6 is the various utility services cables which vertically dispatch those services. Each of these cables can include an appropriate plug which can then be inserted into an appropriate socket in a junction box fastened to the infrastructure of the building or area where the removable wall assembly according to the invention is mounted. This decreases the number of wire-to-wire connections and increases the safety and reliability of these connections.

Figure 21:
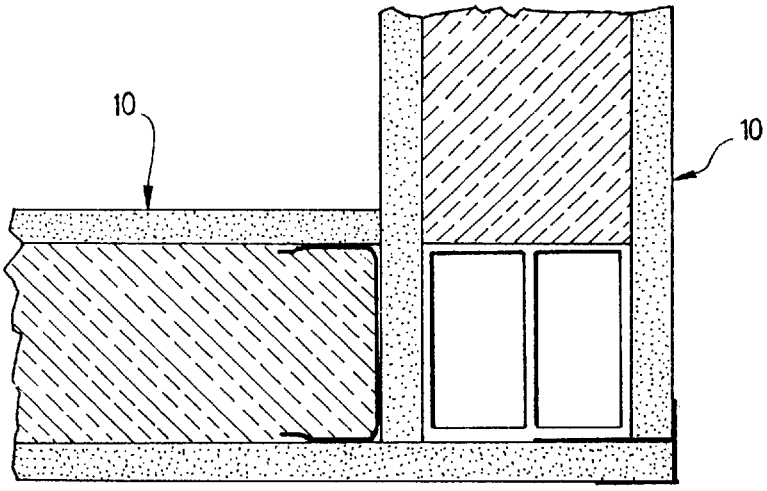
FIG. 21 is a top view of a wall-wall 90° junction.
Figure 22:
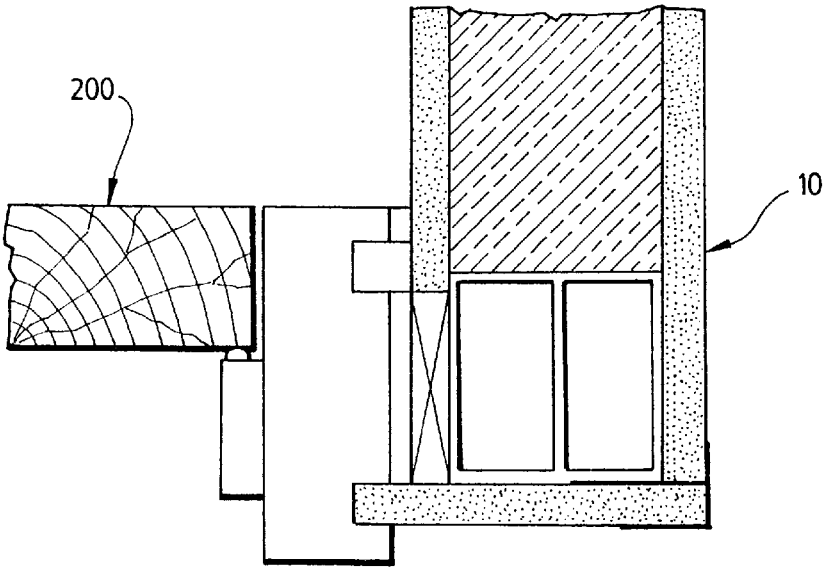
FIG. 22 is a top view of a wall-door 90° junction.
Figure 23:
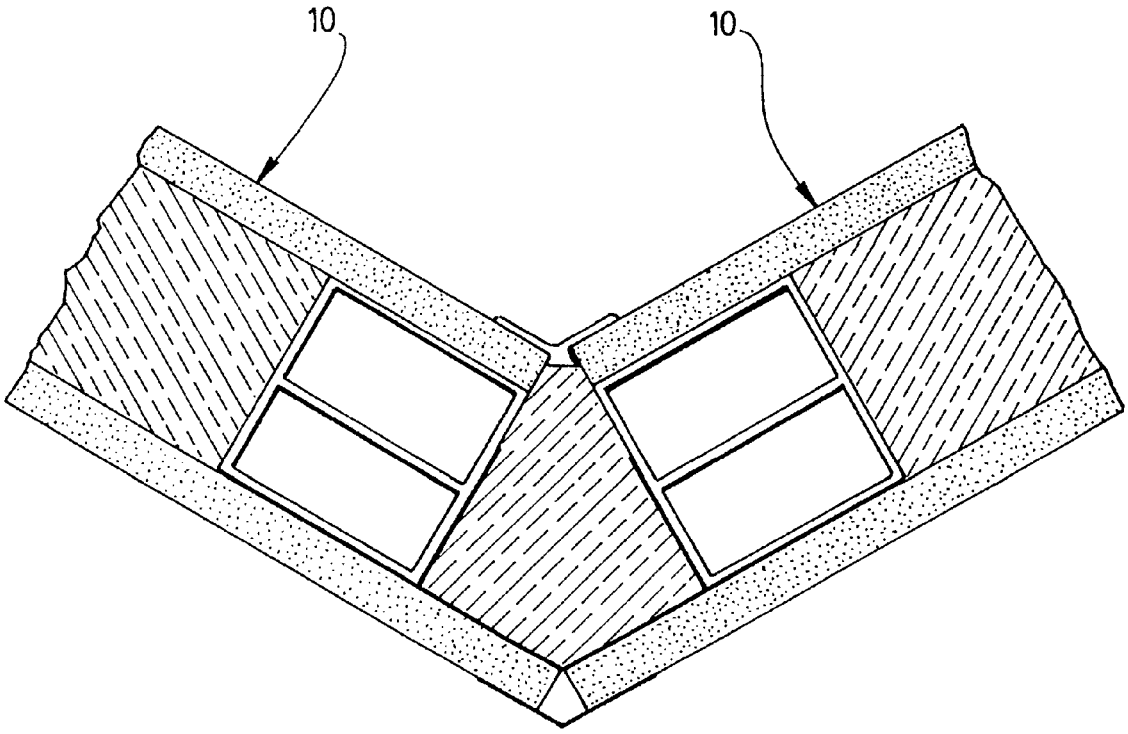
FIG. 23 is a top view of a wall-wall 45° junction.

Further, FIGS. 21, 22 and 23 show respectively how the present invention can be used to assemble a wall-wall 90° junction, a wall-door 90° junction or a wall-wall 45° junction.

Once the wall is assembled, it should be apparent to those skilled in the art that baseboard mouldings 500 can be glued to the floor end of the wall 10 to hide the assembly, as shown on FIG. 2. Further. since walls of any length can be assembled and panels are available in standard sizes, the junction between two adjacent panels can be finished with a standard joint 505 (see FIG. 5).

Preferably, the runners and beams according to the invention are made of galvanized steel, and the panels are preferably plasterboard or gyprock.

Also preferably, each of the grooves of all of the runners are bent slightly inwardly to provide inward pressure so that each of the panels is secured within each groove without mechanical means, as opposed to the slightly outwardly flared groove shown on the accompanying drawings.

It should also be apparent to a person skilled in the art that the whole weight of the assembly rests on the support means 70 and is downwardly transferred from the top to the support means 70 and hence the adjustable foot of each vertical panel, by virtue of the stacking of the elements one on top of the other. This increases the efficiency of the comb-like structure on the bottom of the adjustable foot, since all the weight is concentrated there. Therefore, this assembly provides for excellent lateral stability.

Furthermore, it will be also seen that a wall erected according to the present invention can be easily taken down or disassembled with a minimum of effort. Indeed, since there are few mechanical fasteners, should a reorganization of the space be required, the wall can be disassembled, starting from the ceiling end, and the components may be reused for a new configuration. In such a case it is necessary only to repaint the new assembly once assembled.

It should also be noted that the runners described in the present invention do not necessarily need to be U-shaped, as long as proper grooves or retaining means are provided for all of the runners to properly provide transverse support for the panels used therein.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A removable modular wall assembly for mounting between a ceiling and a floor which are separated by a distance defining a height, said wall assembly having two opposite sides and comprising:

an elongated top runner having a longitudinal axis, two opposite sides, a top surface, a bottom surface and a generally inverted U-shaped cross-section, said top runner having a groove parallel to said longitudinal axis on each opposite side opening towards the bottom, said top runner being compatible with the ceiling for attachment thereto, at least two vertical beams each having an adjustable foot at the bottom thereof, each of said vertical beams having a plurality of longitudinal partitions for vertical dispatching of utility services, each of said vertical beams having a length corresponding generally to the height of said ceiling; each of said beams being provided with support means extending parallel to the longitudinal axis of said top runner at the bottom of the vertical beams;

means for extending each said adjustable foot to account for variations in the height of the ceiling;

a bottom runner having two opposite sides, two opposite ends, a top surface, a bottom surface, a generally U-shaped cross-section and a groove parallel to the longitudinal axis of the top runner on each opposite side defining an opening on the top surface thereof, said bottom runner being inserted between two adjacent vertical beams, each end of said bottom runner resting on a corresponding one of said support means;

a first pair of panels having a horizontal longitudinal axis, each of said panels having a bottom longitudinal edge resting in one of said grooves of said bottom runner and a top longitudinal edge;

lower and upper mid-height runners, said mid-height runners being mirror images of each other along a longitudinal axis, said mid-height runners being in the same shape and form as said bottom runner, said mid-height runners being vertically separated by a generally I-shaped beam defining an opening therebetween on each opposite side of said wall assembly, said lower mid-height runner having a groove on each opposite side opening towards the bottom and adapted to receive the top edge of the corresponding panel of said first pair of panels, each of said mid-height runners being inserted between two adjacent vertical beams and inserted therebetween;

a second pair of panels having a horizontal longitudinal axis, said second pair of panels having a bottom longitudinal edge resting in a respective one of said grooves of said upper mid-height runner, said second pair of panels also having a top longitudinal edge inserted in a respective one of said grooves of said top runner; and at least one modular panel removably covering said opening defined by said I-shaped beams on each opposite side for horizontally dispatching said utility services.

2. A removable modular wall assembly according to claim 1, wherein:

said vertical post partitions each carry a utility service so that said utility services can be fed to said openings between said mid-height runners.

3. A removable modular wall assembly according to claim 1, wherein said at least one modular panel includes pre-wiring for at least one utility service, and wherein said pre-wiring can be operatively connected to an appropriate socket mounted on a vertical beam.

4. A removable modular wall assembly according to claim 1, wherein:

an insulator is inserted between each pair of panels to provide adequate soundproofing.

5. A removable modular wall assembly according to claim 1, wherein:

each of said grooves of each of said runners is bent inwardly to provide inward pressure so that each of said panels is secured within each groove without mechanical means.

6. A removable modular wall assembly according to claim 1, wherein:

said assembly provides for downward accumulation of force so that said assembly is secured to a floor through the accumulated weight of each of the components resting on each of said support means.

7. A removable modular wall assembly according to claim 1, in combination with a plurality of said removable modular wall assemblies arranged end to end to form a complete wall.

8. A removable modular wall assembly according to claim 1, further comprising a door and a door frame integrated with said removable modular wall assembly.

9. A removable modular wall assembly according to claim 1, further comprising a window integrated with said removable modular wall assembly.

10. A removable modular wall assembly according to claim 1, wherein said I-shaped beam has a height of approximately 8 inches.

11. A removable modular wall assembly for mounting between a ceiling and a floor which are separated by a distance defining a height, said wall assembly having two opposite sides and comprising:

an elongated top runner having a longitudinal axis, two opposite sides, a top surface, a bottom surface and a generally inverted U-shaped cross-section, said top runner having a groove parallel to said longitudinal axis on each opposite side opening towards the bottom, said top runner being compatible with the ceiling for attachment thereto, at least two vertical beams each having an adjustable foot at the bottom thereof, each of said vertical beams having a plurality of longitudinal partitions for vertical dispatching of utility services. each of said vertical beams having a length corresponding generally to the height of said ceiling; each of said beams being provided with support means extending parallel to the longitudinal axis of said top runner at the bottom of the vertical beams;

means for extending each said adjustable foot to account for variations in the height between the floor and of the ceiling;

a bottom runner having two opposite sides, two opposite ends, a top surface, a bottom surface, a generally U-shaped cross-section and a groove parallel to the longitudinal axis of the top runner on each opposite side defining an opening on the top surface thereof, said bottom runner being inserted between two adjacent vertical beams, each end of said bottom runner resting on a corresponding one of said support means;

a first pair of panels having a horizontal longitudinal axis, each of said panels having a bottom longitudinal edge resting in one of said grooves of said bottom runner and a top longitudinal edge;

lower and upper mid-height runners, said mid-height runners being mirror images of each other along a longitudinal axis, said mid-height runners being in the same shape and form as said bottom runner, said mid-height runners being vertically separated by a generally I-shaped beam defining an opening therebetween on each opposite side of said wall assembly, said lower mid-height runners having a groove on each opposite side opening towards the bottom thereof and adapted to receive the top edge of the corresponding panel of said first pair of panels, each of said mid-height runners being inserted between two adjacent vertical beams and inserted therebetween;

a second pair of panels having a horizontal longitudinal axis, said second pair of panels having a bottom longitudinal edge resting in a respective one of said grooves of said upper mid-height runner, said second pair of panels also having a top longitudinal edge;

a horizontal runner having the same shape and size as the bottom runner or the mid-height runners, for receiving the top longitudinal edge of said second pair of panels;

a rectangular tube inserted over said horizontal runner and having a pair of downwardly projecting flanges to retain said rectangular tube in position over said horizontal runner and also having an opening at the bottom thereof;

a third pair of panels, having a longitudinal axis, a bottom longitudinal edge resting on top of said horizontal runner on each opposite side and a top longitudinal edge inserted in a respective one of said grooves of said top runner, the third pair of panels being held in position by means of an L-shaped bracket placed at regular intervals between said horizontal runner and said rectangular tube; said third pair of panels having a top longitudinal edge inserted in a respective one of said grooves of said top runner;

wherein the juxtaposition of said horizontal runner and said rectangular tube create a longitudinal opening for vertically dispatching utilities; and at least one modular panel removably covering said opening defined by said I-shaped beams on each opposite side for horizontally dispatching said utility services.

* * * * *

UNITED STATES PATENT AND TRADEMARK OFFICE

CERTIFICATE OF CORRECTION

PATENT NO. : 6,094,875

DATED : August 1, 2000

INVENTOR(S) : Michel LAINE

It is certified that error appears in the above-identified patent and that said Letters Patent is hereby corrected as shown below:

On the Title Page:

Item [86] PCT No., please change "PCT/CA95/00542" to --PCT/CA97/00542--.

Also please change the §371 and §102(e) dates from "May 16, 1998" to --March 16, 1998--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*